US006318222B1

(12) United States Patent
Weinman, Jr.

(10) Patent No.: US 6,318,222 B1
(45) Date of Patent: Nov. 20, 2001

(54) APPARATUS AND METHOD FOR UNIFORM EVEN SLICING

(76) Inventor: Joseph Bernard Weinman, Jr., 77 Dorchester Dr., Basking Ridge, NJ (US) 07920

( * ) Notice: Subject to any disclaimer, the term of this patent is extended or adjusted under 35 U.S.C. 154(b) by 0 days.

(21) Appl. No.: 09/363,897

(22) Filed: Jul. 30, 1999

(51) Int. Cl.[7] ..... B26D 1/00

(52) U.S. Cl. ..... 83/13; 30/279.6; 83/761; 83/699.21; 144/175

(58) Field of Search ..... 83/13, 468.2, 468.5, 83/699.21, 761; 30/114, 115, 116, 282–286, 293, 294, 279.6; 144/182, 184, 185, 186, 189, 190

(56) References Cited

U.S. PATENT DOCUMENTS

| | | | | |
|---|---|---|---|---|
| 54,170 | | 4/1866 | Jones . | |
| 90,623 | * | 6/1869 | Andrews | 83/699.21 |
| 191,799 | * | 6/1877 | Emery | 83/699.21 |
| 775,601 | | 11/1904 | Goldstein . | |
| 1,416,723 | * | 5/1922 | Krafft | 30/279.6 |
| 2,301,737 | | 11/1942 | Miller . | |
| 2,358,210 | | 9/1944 | Brownsey . | |
| 2,423,807 | * | 7/1947 | Zindrick | 144/175 |
| 3,435,524 | | 4/1969 | Moore . | |
| 3,888,005 | | 6/1975 | Bagwell . | |
| 3,955,278 | * | 5/1976 | Popeil | 30/296.1 |
| 3,971,273 | | 7/1976 | Peters et al. . | |
| 3,987,541 | | 10/1976 | Sieczkiewicz . | |
| 4,028,806 | * | 6/1977 | Sheldon | 30/296.1 |
| 4,051,758 | | 10/1977 | Livick . | |
| 4,131,043 | | 12/1978 | Colman et al. . | |
| 4,624,166 | | 11/1986 | Kreth et al. . | |
| 4,856,193 | | 8/1989 | Grachan . | |
| 5,431,078 | | 7/1995 | Ricard et al. . | |
| 5,575,070 | | 11/1996 | Anderson . | |
| 5,617,637 | | 4/1997 | Pai . | |
| 5,664,474 | * | 9/1997 | Punt | 83/761 |
| 5,802,723 | * | 9/1998 | Haggar | 30/293 |

OTHER PUBLICATIONS

"Cook's Wares Catalog" Fall–Winter 1999, No. 55, p. 47, upper left: "Mandolines".

"Chef's " Catalog Fall 1999, p. 43, "Professional Mandoline," p. 56, "Deli Slicer", p. 59 "Adjustable Knife", p. 61, "Bagel Biter", p. 61, "Egg Slicer".

"Professional Cutlery Direct" Catalog Spring 1999. p. 41, Bron Profession Mandoline, p. 41, Electric Food Slicer, p. 17, Wosthof–Trident 8"Bread Knife.

"Williams–Sonoma" Catalog, Autumn 1999. p. 23, Natfer Mandoline, p. 103, Electric Bagel Slicer.

* cited by examiner

*Primary Examiner*—W Donald Bray

(57) ABSTRACT

A cutting implement with a blade, a handle, and a tip, used in conjunction with a planar support surface upon which food or a similar substance rests. The handle and tip cooperate to maintain the blade parallel to, and a pre-determined distance from, the support surface during a reciprocal horizontally-translating slicing motion, thus ensuring that slices are produced with two parallel planar surfaces which are uniformly of a pre-determined thickness.

43 Claims, 12 Drawing Sheets

APPARATUS AND METHOD FOR UNIFORM EVEN SLICING

BACKGROUND

This invention relates to hand-held slicing implements, primarily for food substances and products, and for other materials such as wood or plastic.

Slicing and related techniques such as peeling and filleting are among the most basic and important techniques in food preparation. Desserts, such as cake, and savory foods, such as tomatoes, potatoes, eggplants, meats, cheeses, and poultry, are typically sliced for consumption in raw form, prior to cooking, or subsequent to cooking. Such slicing may be performed before, during or after other operations such as rolling, stuffing, folding, etc., e.g., eggplant rollatini. For desserts, it is often necessary to slice objects such as a cake, either to level the top or to provide for multiple layers. Common examples of slicing and related techniques include halving bagels, filleting fish, butterflying veal chops, skinning salmon, peeling canteloupe, de-veining shrimp, removing the rind from cheese, leveling tortes, and layering cakes or creating other layered savory or dessert foods such as napoleons. It is important that such slices be level, even and uniform, and that the process of slicing does not deform or otherwise damage the foodstuff. A given individual slice is considered level and even when it has two surfaces which are substantially planar and parallel to each other. Slices of a group are uniform when all slices are of the same thickness. Thickness is pre-determined when one can select the thickness of the slice prior to cutting. Different prior art methods may provide for one or more of the above properties: e.g., one can easily envision an apparatus wherein all slices are level, even, and uniform, but not of pre-determined thickness (e.g., the first slice, of random thickness, would be used as a template for subsequent slicing). There are four main reasons for chefs being desirous of achieving level, even, uniform slices of pre-determined thickness.

- presentation—i.e., professional, aesthetically pleasing appearance. A slice which is not of uniform thickness throughout, or a group of slices which are not all of the same thickness, appear amateurish and careless.
- evenness of cooking—it is usually important that the entire batch of food be sufficiently, but not overly, cooked. Internal temperature and degree of doneness are directly related to slice thickness, hence even cooking requires uniform, even slices.
- structural—e.g., in making eggplant rollatini, the eggplant must be thin enough to roll easily, yet not so thin as to break during cooking. When butterflying a veal chop for stuffing and subsequent barbecuing, the stuffing must not leak through either side of the veal.
- achievement of planned outcome—e.g., if a cake is intended to be seven layers thick, and in the oven has risen to just over three inches, a chef would need to pre-determine the thickness to be ⅜ inch. Also, if it is known that carrot slices which are ¼ inch thick must be boiled for 1 minute to achieve a desired degree of doneness, cooking times can be planned exactly instead of estimated, and prior experience can be used.

In addition to slicing, several other cutting operations are typically performed. One is mincing, wherein using a chef's knife with the handle held between the thumb and forefinger of one hand, and the blade held near its end with the thumb and forefinger of the other hand, a rapid rocking motion minces the food to be cut into smaller and smaller morsels. Another is cutting through relatively tough, durable substances, such as frozen meat or poultry, where downward pressure must be applied on both sides of the section of blade contacting the item to be cut: not only at the handle, but also at the end of the blade. One illustrative embodiment shown here provides novel improvements over the prior art which also provides for safer and easier mincing as well as safer cutting through tough substances with less wasted effort and less pain to the hands.

The prior art provides a variety of apparati and methods for slicing, which either are inadequate in achieving their intended objective, or are overly complex, expensive, and difficult to maintain. Knives commonly found in the kitchen—such as serrated bread knives or Chef's knifes—neither guarantee that slices are level, nor even, nor uniform, nor of pre-determined thickness.

One major class of prior art knives have a guide attached at either one end or both ends of the blade. An example of a knife having a guide attached at one end is illustrated in U.S. Pat. No. 5,575,070 issued Nov. 19, 1996 to Anderson. Anderson discloses a knife with a cantilevered guide substantially the same length as the knife blade. This cutting implement includes a handle, an elongated blade, a guide adjustable with respect to the blade, and a knob substantially received in a cavity formed in the upper region of the handle. The knob protrudes from the cavity and cooperates with the guide so that a user can adjust the space between the guide and the blade by rotation of the knob.

Another example is U.S. Pat. No. 5,617,637, issued Apr. 8, 1997 to Pai. Pai discloses a sheet-like blade connected to a handle with a sharpened lower cutting edge, with an L-shaped support piece which is connected to a press piece (i.e., guide) which consists of a press seat, a horizontal upper portion, and a vertical portion perpendicular to the upper portion, and thus substantially parallel to the blade.

Other examples, wherein the guide is attached at both ends of the blade are illustrated in U.S. Pat. No. 2,301,737 issued Nov. 10, 1942 to Miller, and U.S. Pat. No. 775,601 issued Nov. 22, 1904 to Goldstein. Miller discloses a knife with a guide which attaches to both the handle and the tip. Goldstein discloses a similar knife which cooperates with a slicing board having a receiving groove.

In U.S. Pat. No. 2,358,210, issued Sep. 12, 1944, Brownsey discloses a knife with two blades, on either side of a central member which acts as a guide.

All of these prior art designs suffer from the same weaknesses. First, while the guide does in fact prevent the thickness from exceeding a certain pre-determined amount, it does nothing to prevent the slice from being less than this pre-determined thickness. Second, since the guide follows the outside of the substance being sliced, the guide essentially propagates the contour of the outside surface, thus replicating any existing curvature, waviness, or other unevenness. Third, while a knife with a guide can function, albeit subject to the above weaknesses, in vertically slicing an object such as a loaf of bread, it is not well suited to horizontally slicing an object such as a torte or cake. Finally, such knifes are poorly suited to halving an object such as a bagel, due to the difficulty of grasping the object safely while attempting to cut it.

Another prior art approach is represented by U.S. Pat. No. 4,624,166 issued Nov. 25, 1986 to Kreth et al. Such a device, commonly known among chefs as a mandoline, provides a flat bed upon which the food is moved, thus intercepting a blade offset from the surface, resulting in a slice. This approach is reasonably well suited to small food objects with sufficient stiffness, such as carrots and potatoes. However, there are a number of deficiencies with this approach as well.

First, the approach does not work with delicate foodstuffs such as layer cake, which would simply deform and/or crumble when subjected to the force which would be required to attempt to slice them against the blade. Secondly, many foodstuffs such as white bread, pastries, and tomatoes, have a skin which is relatively tough with respect to their internal stiffness, such that they would merely deform, i.e., be crushed, merely by being pressed against the blade. They require a reciprocal cutting motion—as would be exercised in the use of a typical serrated knife—to be sliced without being crushed. Third, any large object such as a cake would fall apart well before it could be fully forced through such an apparatus, since the portion which has already been sliced is unsupported and deformed through the process of working its way through the slicer. Fourth, even for objects which would not fall apart, such as potatoes, the weight of the majority of the slice increasingly deforms the slice as the final part of the cut is made, creating a lip thicker than the intended slice thickness on the trailing edge of the slice once it regains its original state.

Another category of apparati for producing even, uniform slices consists of knives together with structures with regularly spaced slots or guiding edges which receive and guide a "regular" knife. An example of such a device is illustrated in U.S. Pat. No. 4,131,043, issued Dec. 26, 1978 to Colman et al. Colman discloses a food-slicing device having a food supporting cradle formed of a pair of vertically upstanding lateral wall members and an intermediate web section therebetween, the wall members diverging upwardly and outwardly from the web section, and an anvil tray extending forwardly of the leading edges of the lateral wall members and web section to receive sliced food material produced upon cutting the food in a plane closely adjacent the leading edges of the wall members and web section.

Another illustrative example is U.S. Pat. No. 3,987,541, issued Oct. 26, 1976 to Sieczkiewicz. Sieczkiewicz discloses a guide for cutting a cake into multiple layers, wherein a pair of vertically positioned walls are joined adjacent their rear edges in a generally V-shape. The walls are slanted to taper upwardly from an integral base portion to an integral top and forming an open front. The front edges of the walls are provided with spaced horizontal slots extending inwardly from their front edges. The slots in each wall are evenly spaced and are in horizontal alignment with each other whereby a knife blade can be inserted horizontally between pairs of slots to be held in a horizontal position at a pre-determined level. A cake can be turned against the knife blade to slice a horizontal layer from the top portion of the cake. The blade can then be successively lowered from slot to slot to cut the cake into a plurality of uniformly spaced layers. The main shortcoming with these designs is their complexity, wherein not only is a knife required, but also a bulky, mechanically complex auxiliary device to guide the knife. In addition, the quality of such guiding is suspect, either because the knife is only supported at one end, or because the guide only limits motion to be within one half-space, instead of a particular pre-determined cutting plane, or because the method of registering the foodstuff, i.e., incrementing its position for the next slice assures evenness of each slice, but not uniformity among slices.

Finally there are a variety of designs for professional rotary slicers, which function reasonably well but are, compared to their manual counterparts, relatively expensive, mechanically complex, and difficult to clean and otherwise maintain. They also only function well only for a limited range of foodstuffs, such as those which can be sliced thin and yet retain their structural integrity, e.g., luncheon meats and some cheeses.

Also of note is U.S. Pat. No. 3,888,005, issued Jun. 10, 1975 to Bagwell. Bagwell discloses a knife where the tip of the knife, by extending below the cutting edge of the blade, is designed to prevent the knife from scratching, abrading, or cutting a flat support surface, which is supporting an article being cut. Although suitable for this purpose, this knife is not at all useful for ensuring even, uniform slices and is noted merely because the invention disclosed here in some embodiments, in addition to ensuring even, uniform slices, has as an additional benefit the similar ability to protect the support surface.

SUMMARY

The novel invention disclosed here is a knife used for slicing objects such as foodstuffs. A handle substantially at one end of the knife, used for grasping and manipulating the knife, works in conjunction with a tip, substantially at or near the other end of the knife, to keep the cutting edge of the knife parallel to a planar support surface. Thus, when the knife is maintained against the planar support surface as it is conducted in a horizontal slicing motion, an object can be sliced one or more times into portions which are of uniform, predetermined thickness. Moreover, since the cutting plane formed through the motion of the knife, relative to the object to be cut, is parallel to the support surface on which the object rests, slices with parallel surfaces are assured.

BRIEF DESCRIPTION OF THE DRAWINGS

FIG. 12 is exploded. FIGS. 13 and 14 are partial (close-up) views of part of FIG. 12, with FIG. 13 exploded and FIG. 14 assembled. Similarly, FIGS. 15 and 16 are partial (close-up) views of part of FIG. 12, with FIG. 15 exploded and FIG. 16 assembled.

REFERENCE NUMERALS IN DRAWINGS

Figure 1:
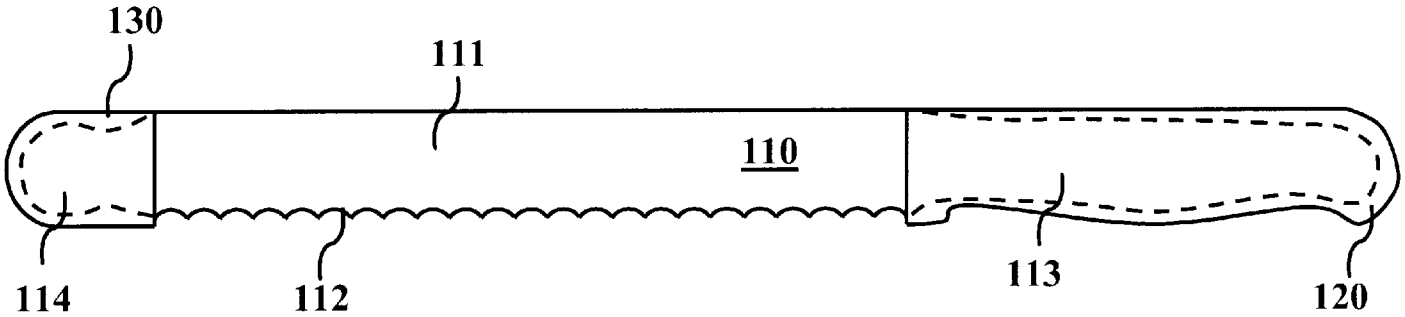
FIG. 1 shows a top view of a typical embodiment.

100 knife
- 110 blade
  - 111 blade backbone
  - 112 cutting edge

113 handle tang
114 tip tang
115 tip tang slot
120 handle
121 handle pin
122 handle spacer
123 handle hole
124 handle spacer hole
125 handle slot
127 handle tang hole
128 handle recess
129 handle pad
130 tip
131 tip pin
132 tip spacer
133 tip hole
134 tip spacer hole
135 tip slot
136 tip finger
137 tip tang hole
138 tip recess
139 tip pad
200 support surface
300 object

DETAILED DESCRIPTION

Figure 2:
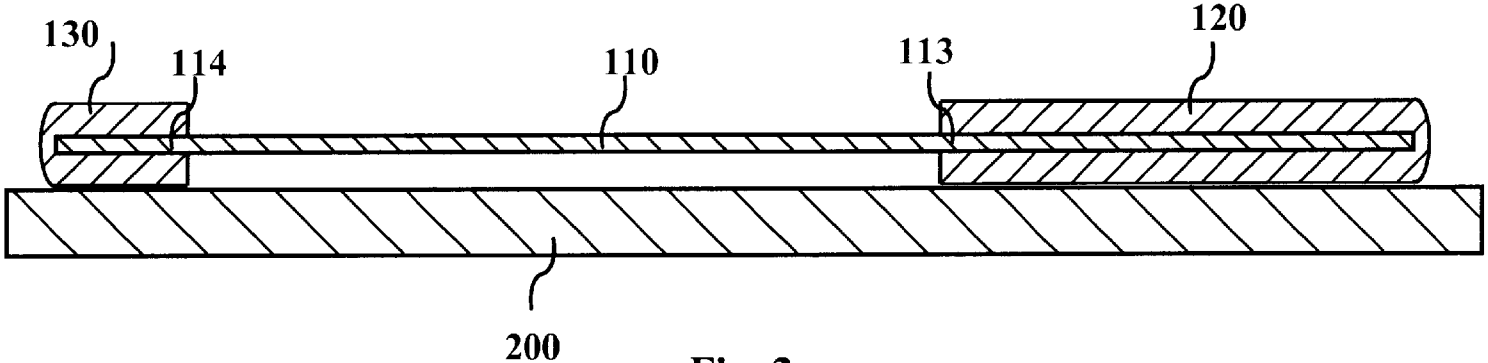
FIG. 2 shows an elevational cross-section view of a typical embodiment.
Figure 3:
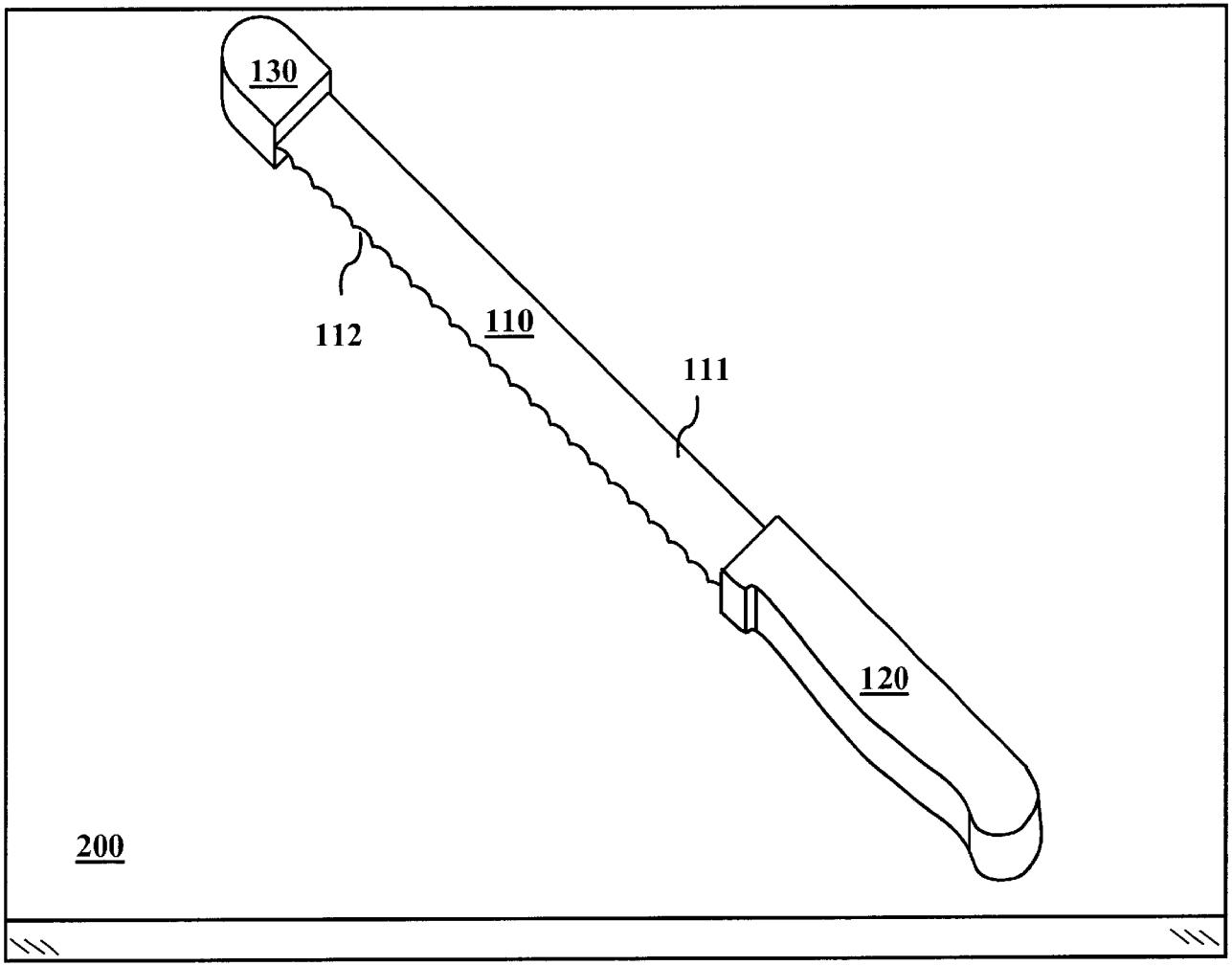
FIG. 3 shows an isometric view of a typical embodiment.
Figure 4:
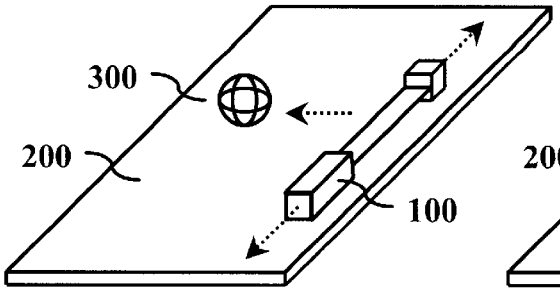
FIGS. 4 to 11 show stylized isometric views of a variety of methods of use of the typical embodiment.
Figure 5:
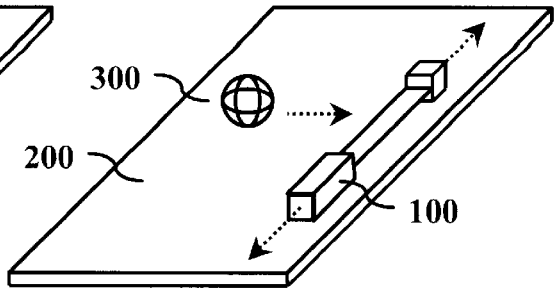
Figure 6:
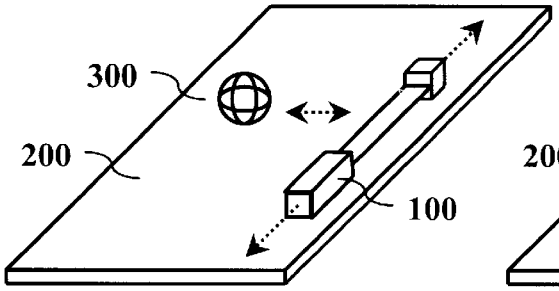
Figure 7:
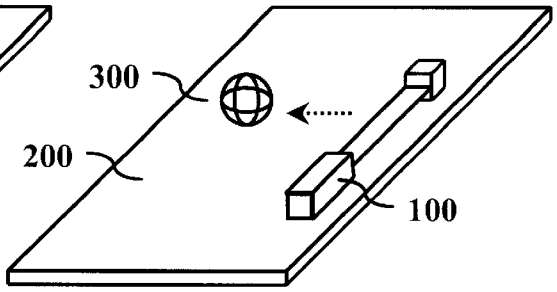

A typical embodiment of the present invention is illustrated in FIGS. 1 through 3, with methods of use illustrated in FIGS. 4 through 11. FIG. 1 shows, in top view, a knife 100 that includes a handle 120, a tip 130, and a blade 110. Blade 110 includes a blade backbone 111, a cutting edge 112, a handle tang 113, and a tip tang 114. FIG. 2 shows an elevational cross-section view of knife 100, and also shows a support surface 200. FIG. 3 shows an isometric view of knife 100 and support surface 200.

Blade backbone 111 ensures the structural integrity, i.e., linearity, of cutting edge 112, which performs the actual cutting. Blade backbone 111 is of sufficient strength to neither warp nor buckle during use. Handle 120 is coupled to handle tang 113, and provides a means for the user to grasp the knife. Tip 130 is coupled to tip tang 114. When knife 100 is resting on support surface 200, or when knife 100 is being reciprocally translated while maintaining continuous contact with support surface 200, handle 120 and tip 130 maintain cutting edge 112 at a pre-determined distance from support surface 200. Handle 120 and tip 130 normally continuously maintain contact with support surface 200 and, thus, ensure that cutting edge 112 is restricted to translate in a fixed cutting plane that is parallel to support surface 200. Handle 120 and tip 130 are of sufficient width, either singly or in combination, to prevent rotation of blade 110 about its longitudinal axis, thus ensuring that cutting edge 112 is maintained a pre-determined distance from support surface 200. Support surface 200 is of sufficient area, i.e., breadth and depth, to continuously support knife 100. It is of sufficient thickness and strength to avoid warping from the weight of object 300, knife 100, and any pressures which might be exerted in the course of normal use of the apparatus.

Figure 10:
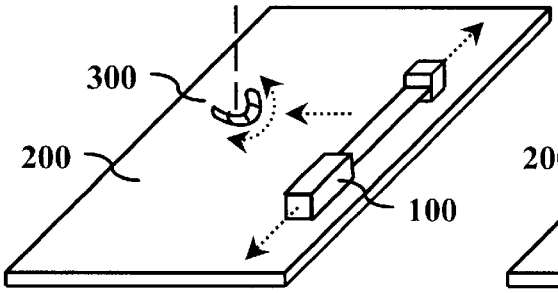
Figure 11:
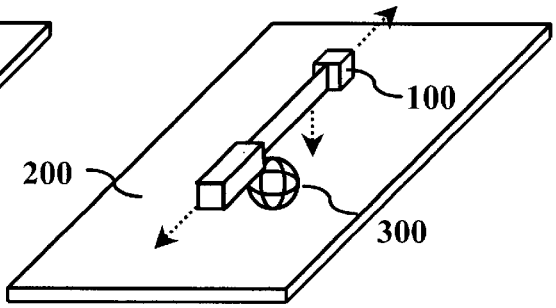
Figure 12:
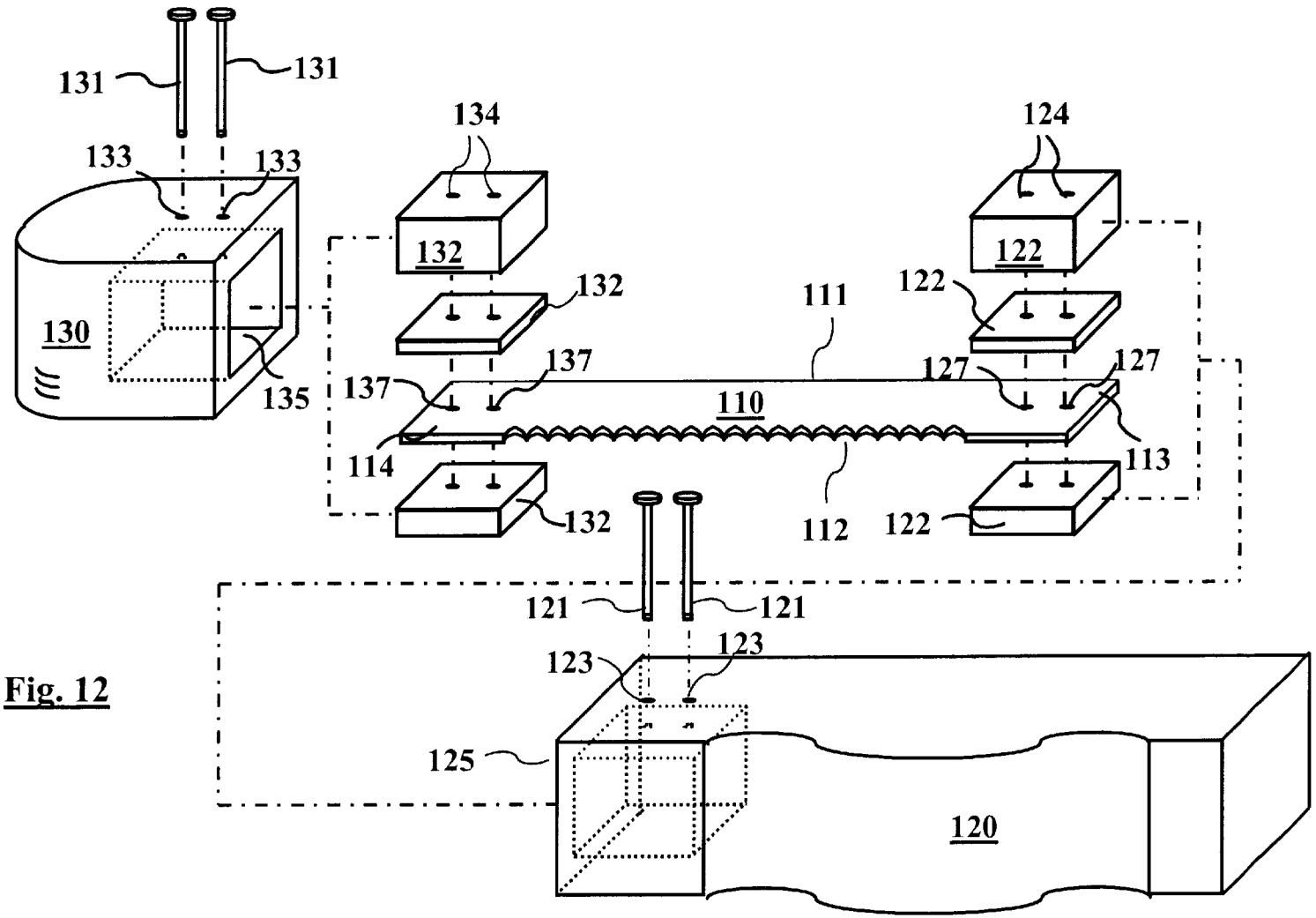
FIGS. 12 to 16 show isometric views of an embodiment wherein the slice thickness is pre-determined, but adjustable via means of spacers.
Figure 13:
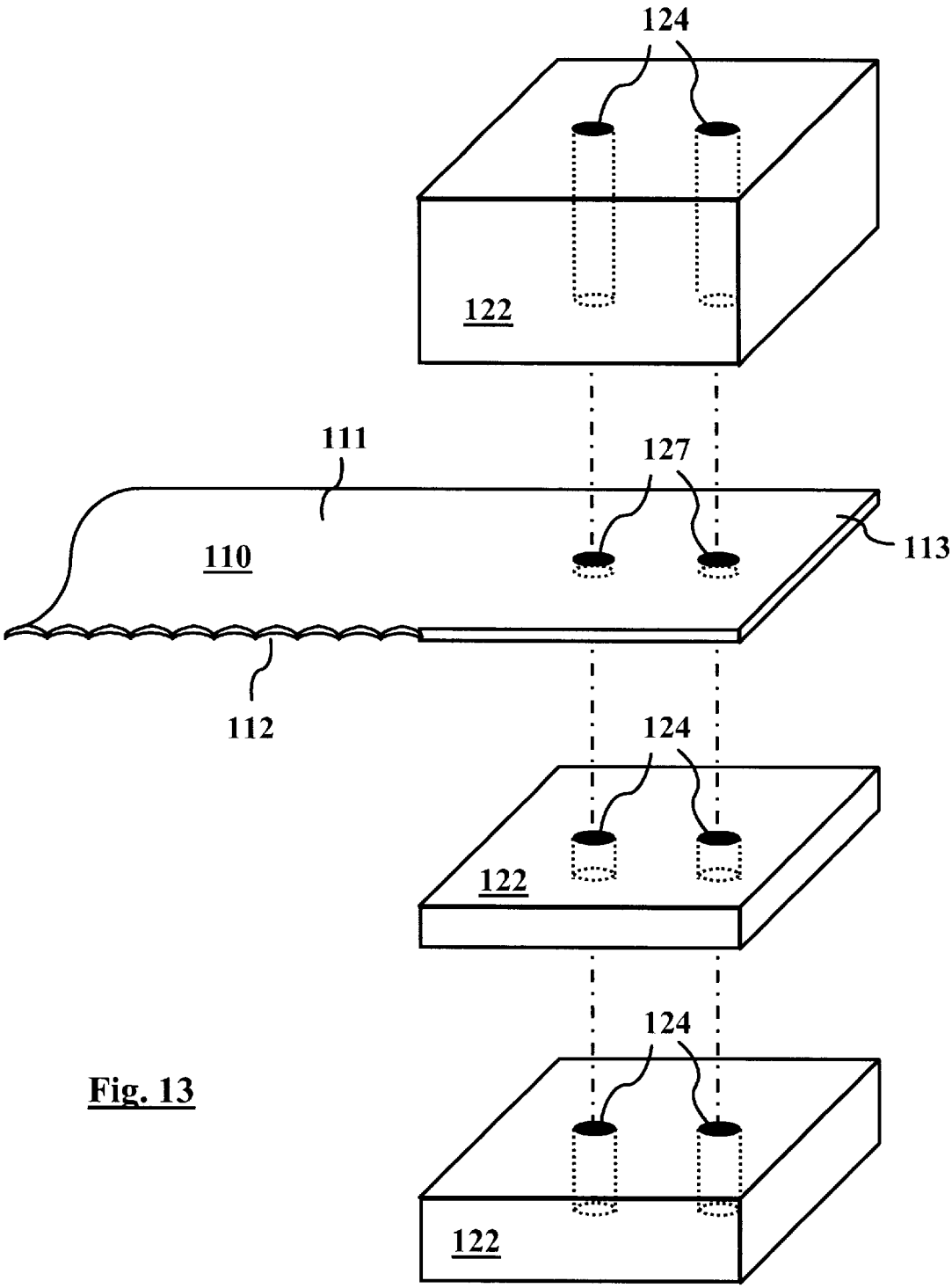
Figure 14:
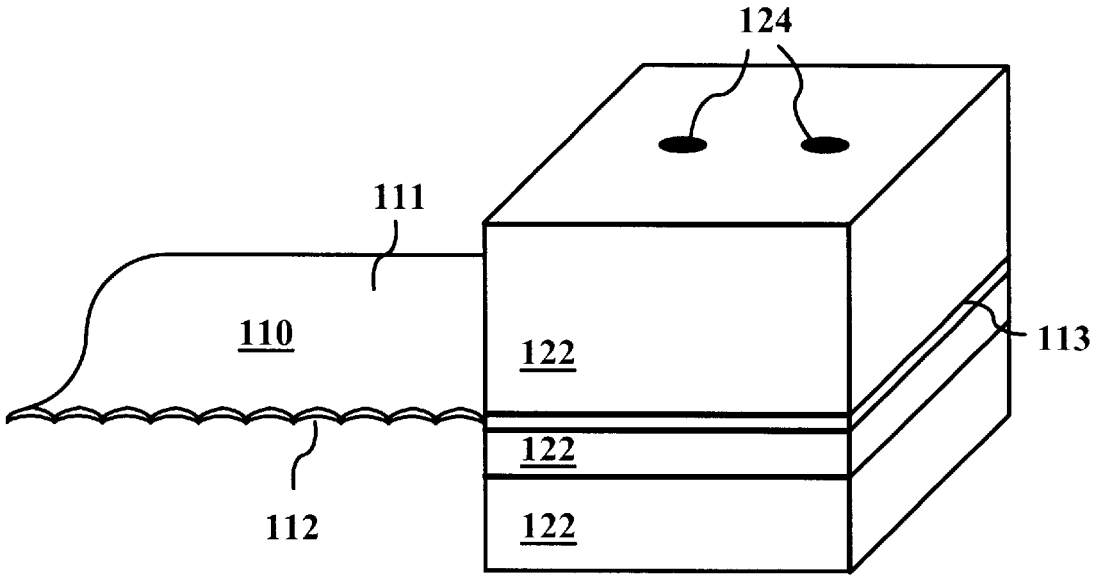
Figure 15:
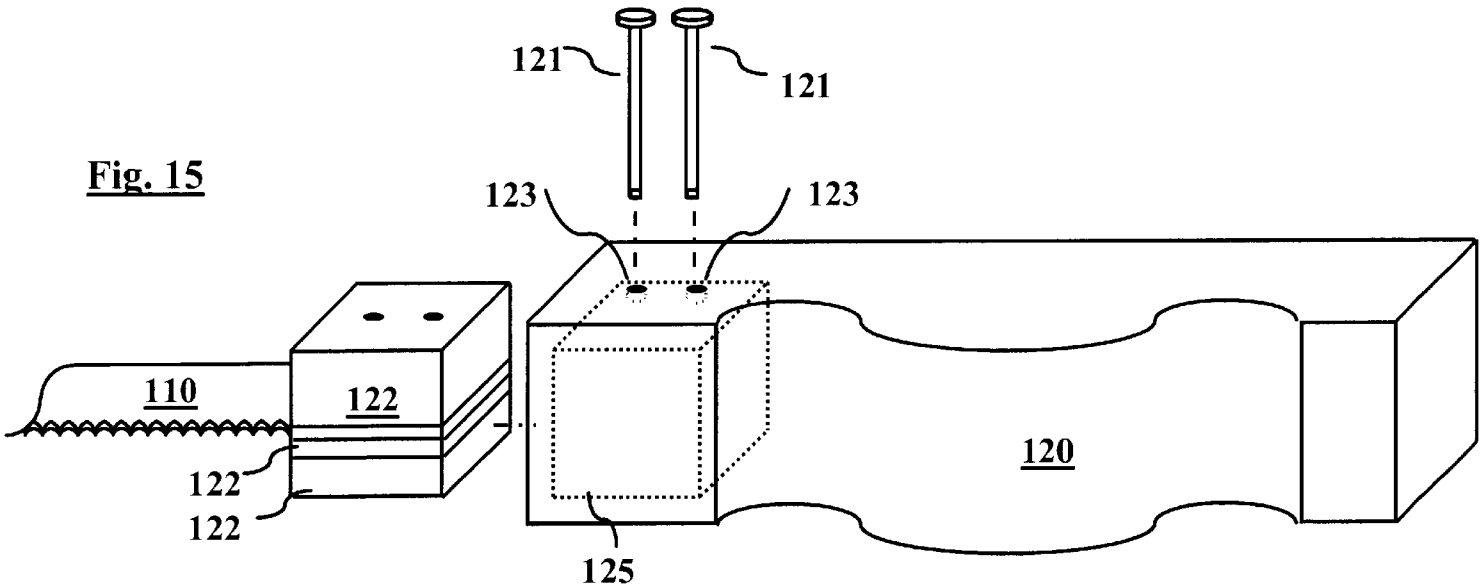
Figure 16:
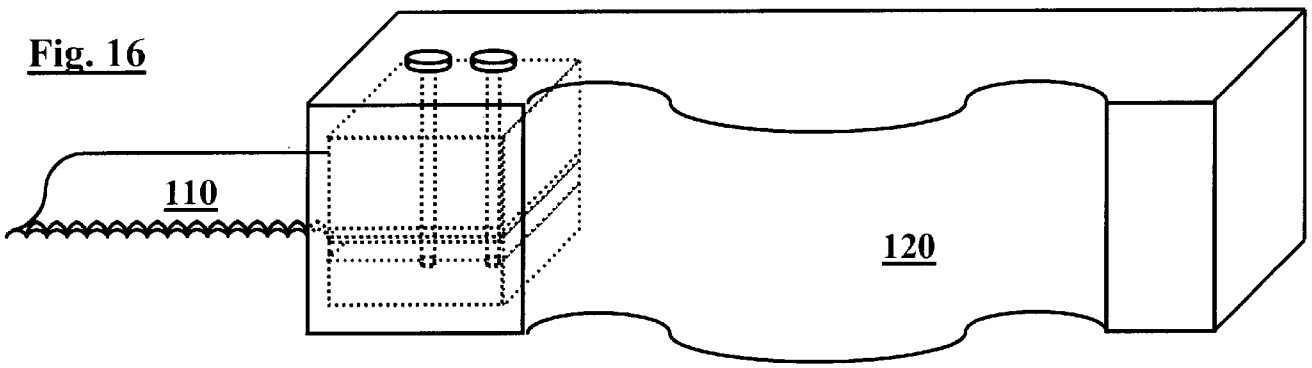

FIGS. 4 through 11 show support surface 200, knife 100 (in stylized form) and an object 300 that is to be cut, and illustrate some of the different methods of use. This includes different combinations of knife 100 slicing horizontally (FIGS. 4 through 10) or vertically (FIG. 11); knife 100 reciprocating (FIGS. 4 through 6 and 9 through 11) or fixed (FIGS. 7 and 8); object 300 reciprocating (FIG. 8), fixed (FIGS. 4, 7, and 11), rotating about an axis parallel to cutting edge 112 (FIG. 9), or rotating about an axis skew to cutting edge 112 (FIG. 10). Movement is depicted by a single arrow, and reciprocation is depicted by a pair of arrows pointing in opposite directions. Illustratively, in the typical method depicted in FIG. 4, while holding object 300 in place and while continuously maintaining knife 100 in contact with support surface 200, knife 100 is moved substantially reciprocally along its longitudinal axis, while translated in a direction substantially perpendicular to said longitudinal axis. Handle 120 and tip 130 maintain constant contact with support surface 200, and thus cutting edge 112 is substantially constrained to travel in a cutting plane parallel to support surface 200.

In the embodiment shown in FIGS. 1 through 3, the thickness of cut is pre-determined, and not adjustable. However, in an alternate embodiment illustrated in FIGS. 12 through 16, one or more handle spacers 122, cooperate with tip spacers 132 to form a platform which predetermines the distance of blade 110 to support surface 200. A variety of alternate embodiments of these handle spacers 122 and tip spacers 132 can be easily designed by those skilled in the art. For example, they may all be the same thickness. Or they may be a variety of thicknesses, e.g., in powers of two, to maximize the number of permutations and therefore the variety of alternate thickness combinations. Should spacers differ in thickness, they may advantageously be color-coded or otherwise marked to facilitate matching the arrangement of handle spacers 122 with the arrangement of tip spacers 132 so as to ensure that blade 110 is parallel to support surface 200. A variety of means also exist for assembling handle spacers 122, handle tang 113, and handle 120 together. In the illustrations, handle pins 121 are threaded through handle holes 123, handle spacer holes 124, and handle tang holes 127 to lock the handle spacers 122 and handle tang 113, assembled together and inserted into handle slot 125, and handle 120 together into a fixed assembly. Similarly, tip pins 131 are threaded through tip holes 133, tip spacer holes 134, and tip tang holes 137 to lock the tip spacers 132 and tip tang 133, assembled together and inserted into tip slot 135, and tip 130 together into a fixed assembly. Other embodiments could provide snap together assemblies, with such snapping together being the primary means of assembly, and/or in conjunction with handle pins 121 and tip pins 131, and/or an assembly held together by friction, etc. Perimeter ridges on one surface which cooperate with perimeter depressions, or other cooperating topographies, as in a child's snap together plastic blocks, may be used to facilitate alignment, assembly, or cleaving of spacers.

Figure 17:
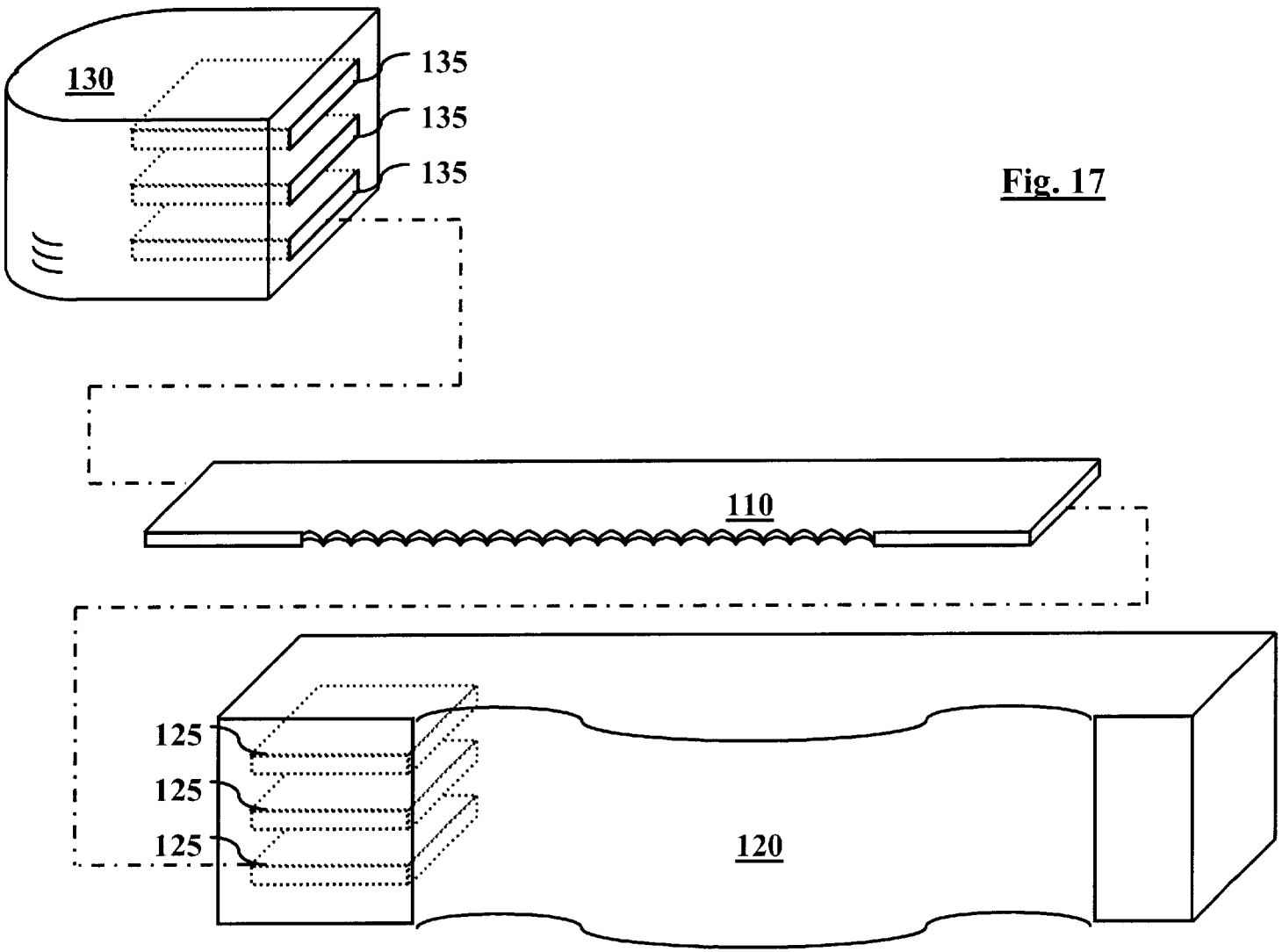
FIG. 17 shows an exploded isometric view of an alternate embodiment wherein the slice thickness pre-determined, and adjusted through the use of parallel slots which receive the blade.

Another embodiment which provides means for predetermination of slice thickness is illustrated in FIG. 17. Here, blade tang 113 may be received by one of a multiplicity of handle slots 125 interiorly contained in handle 120 and tip tang 114 may be received by one of a multiplicity of tip slots 135 interiorly contained in tip 130. As shown here, this assembly remains unitary through friction. As above, pins, screws, snaps, or other connectors may be used instead.

Alternatively, pre-determination of slice thickness may be adjusted via a screw-type mechanism, such as is found in a caliper. Yet another means of adjustment is by nesting sleeves, or stacking snap-together blocks, which cooperate to increase the thickness of handle 120 and tip 130, and thus, the distance of the cutting plane formed through the reciprocal translation of cutting edge 112 from support surface 200. Yet another means of adjustment is by stacking elements of cross-section similar to the handle and the tip.

Assembly of such stacking elements on one or both sides of blade 100 adjusts the pre-determined distance of blade 100 from support surface 200. Those skilled in the art will appreciate that any number of designs exist involving assembly, movement, positioning, etc., to adjust the pre-determined slice thickness.

Figure 18:
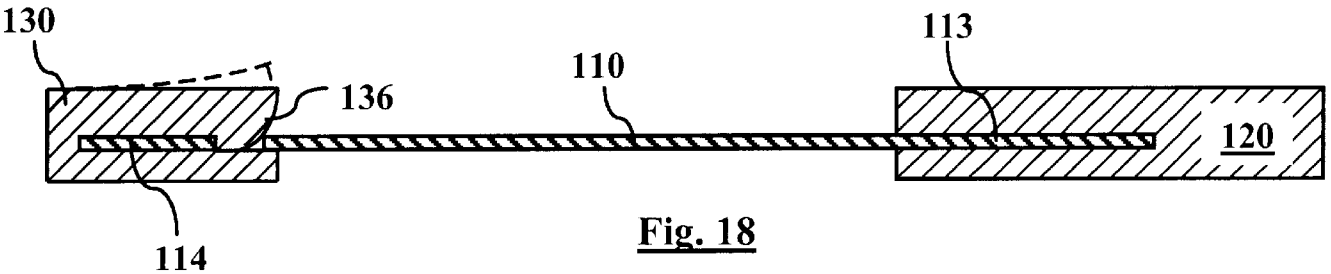
FIG. 18 shows an elevational cross-section view of an embodiment with a removable tip.
Figure 19:
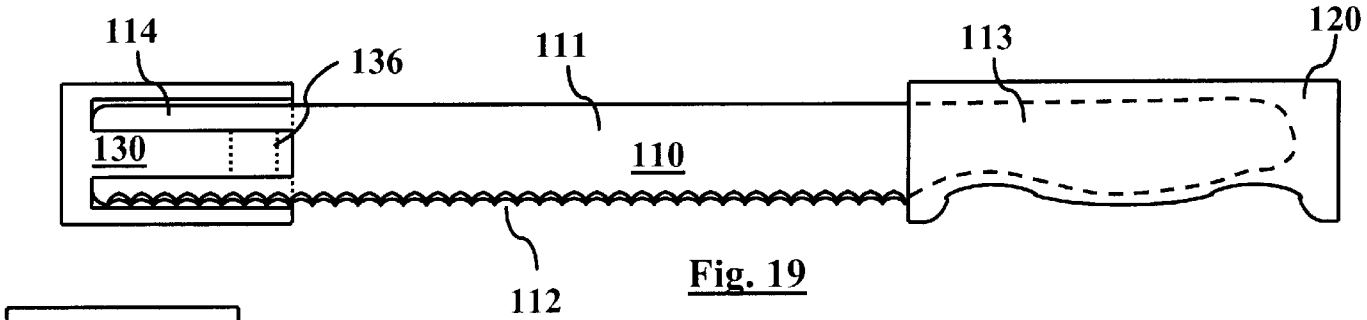
FIGS. 19 and 20 show top views of an embodiment with a removable tip.
Figure 20:
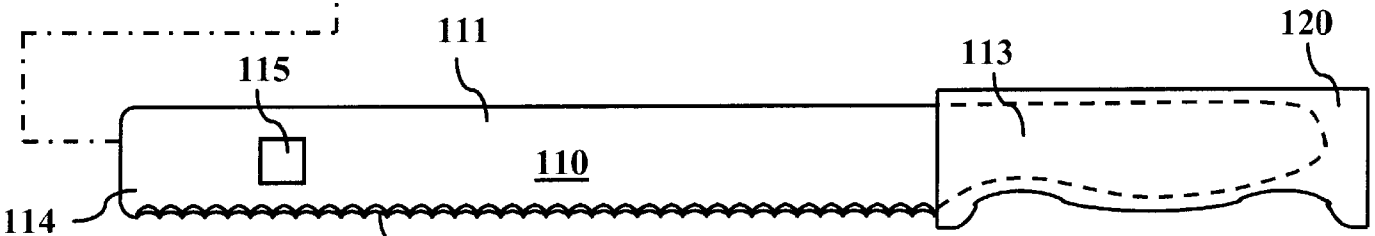

FIGS. 18 through 20 illustrate an embodiment wherein tip 130 may be removed from tip tang 114 and/or reattached. Tip finger 136 is received into tip tang slot 115, thus locking tip 130 to blade 110. Various embodiments providing means for removeability of tip 130 will be obvious to those skilled in the art. For example, tip 130 may be a simple clip with two leaves that together sandwich blade 110, the thickness of such a sandwich matching that of handle 120, or tip 130 may act as a scabbard or ring about blade 110. Alternate embodiments may have tip 130 be a leg present on only the bottom side of blade 110, perhaps fixed in place via a snapping assembly of a protrusion in tip 130 to a matching tip tang slot 115. Tip 130 need not necessarily even have substantial extent perpendicular to the line of cutting edge 112, as long as handle 120 has sufficient extent to form at least a tripod.

Figure 21:
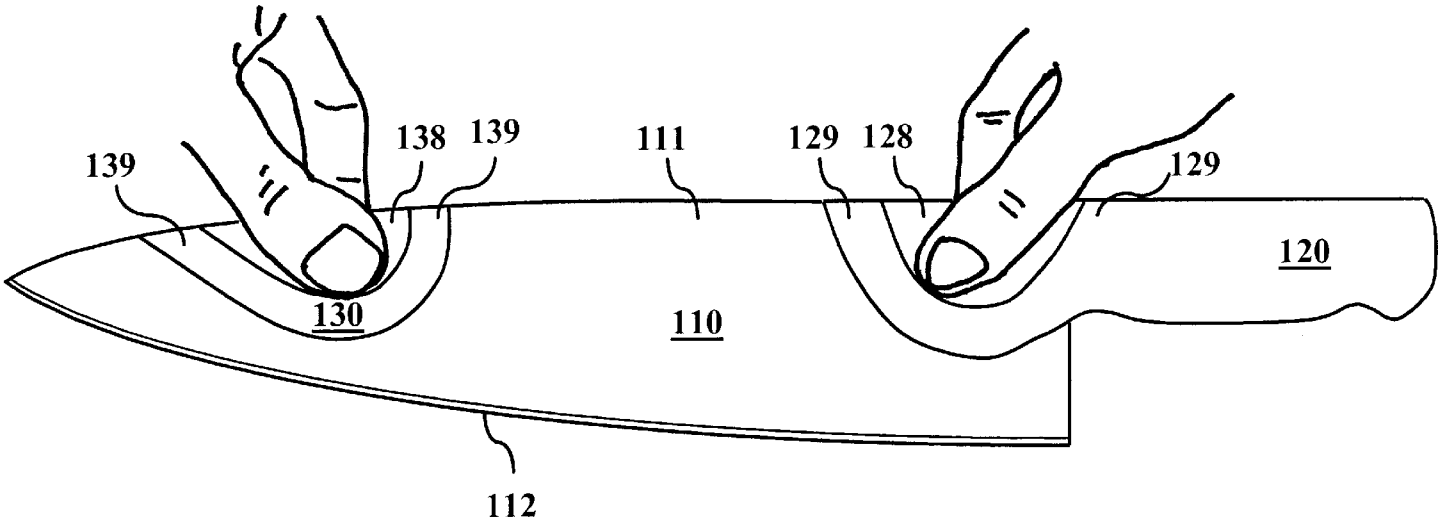
FIG. 21 shows a side view of an embodiment being used for vertical cutting particularly suitable for safe mincing and painless cutting through tough materials.
Figure 22:
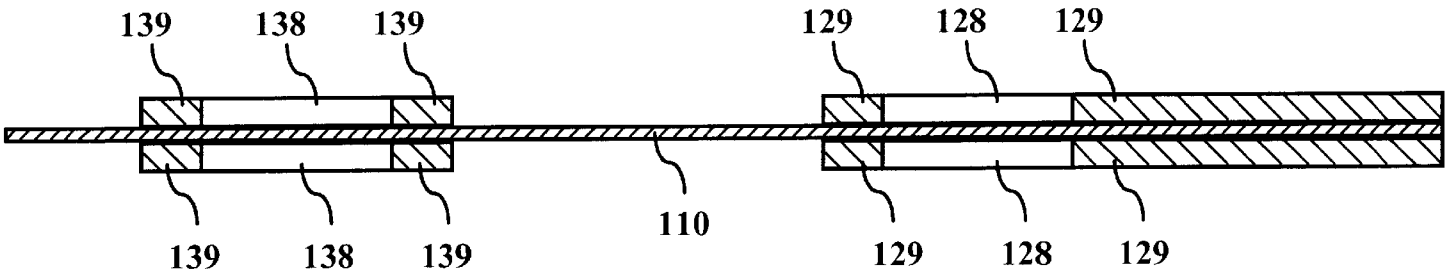
FIG. 22 shows a top cross-section view of the same embodiment.
Figure 23:
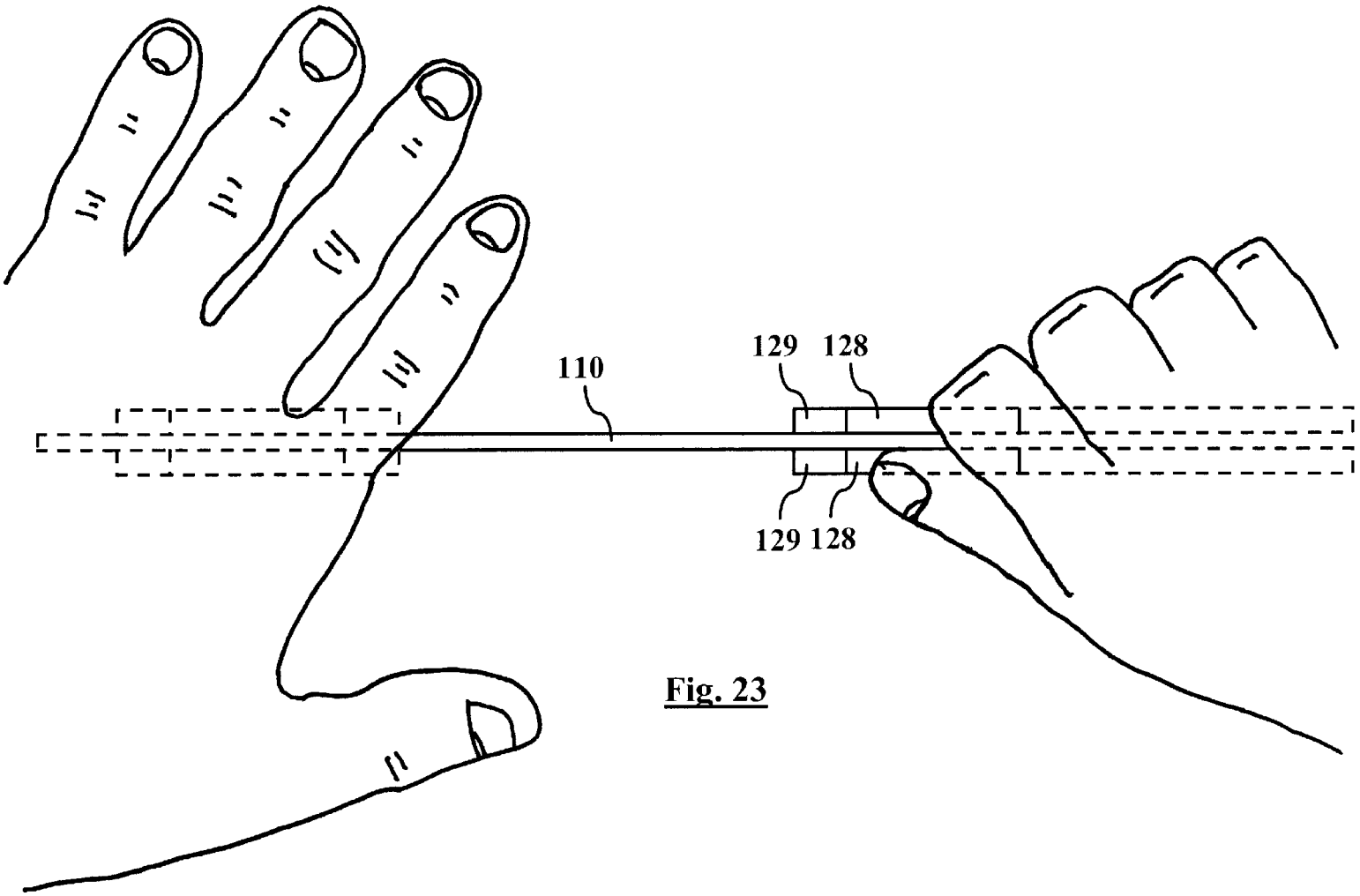
FIG. 23 shows a top view of the same embodiment being used for vertical cutting through a tough material.

FIGS. 21 through 23 show an alternate embodiment of knife 100, wherein handle 120 has handle recesses 128 thus leaving handle pads 129 and tip 130 has tip recesses 138 thus leaving tip pads 139. Advantageously, a thumb and forefinger may be received into handle recesses 128 as well as tip recesses 138, as shown in FIG. 21. Such a design, in addition to all the benefits ascribed to the base invention, also supports safety during mincing, as shown in FIG. 21. In addition, tip pads 139 in this embodiment, provide a contact surface which alleviates painful pressure associated with prior art knives when cutting through tough substances, as shown in FIG. 23.

Figure 24:
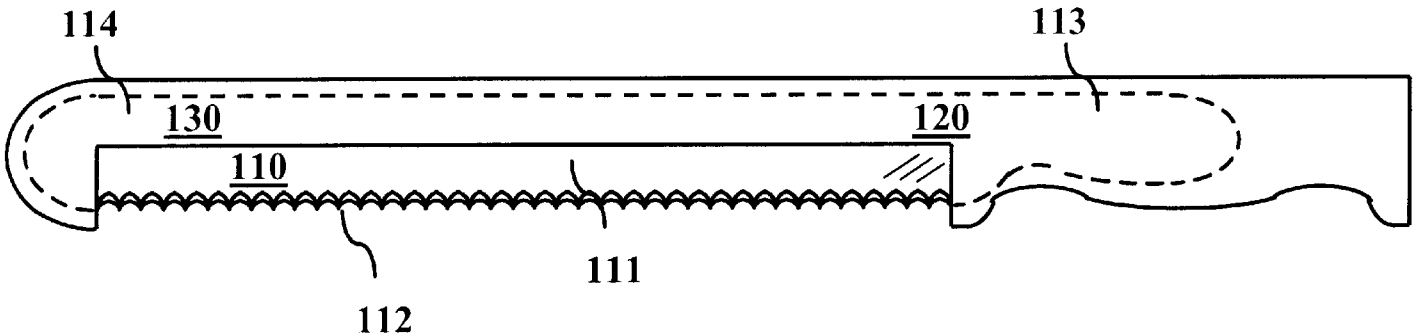
FIG. 24 shows a top view of an illustrative embodiment of the invention which limits the depth of cut to a pre-determined amount.
Figure 25:
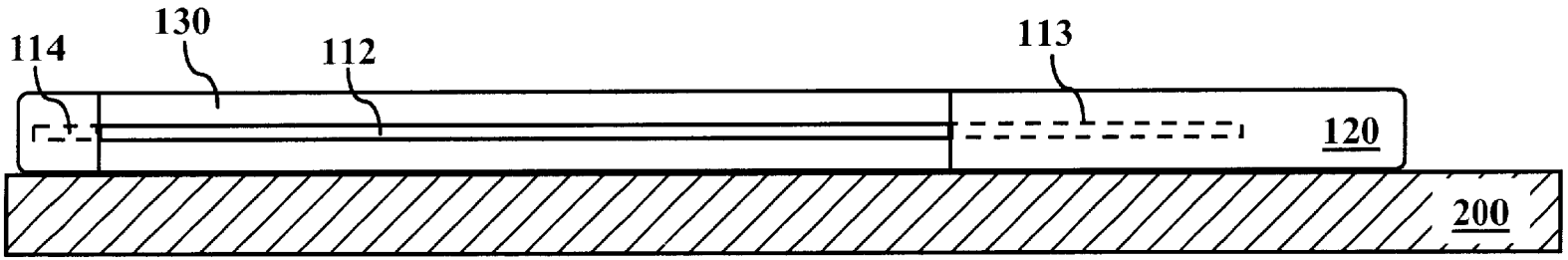
FIG. 25 shows an elevational view of the same embodiment.

FIGS. 24 and 25 show an alternate embodiment wherein handle 120 and tip 130 are extended towards each other substantially contiguously about blade backbone 111 in such a way as to limit the depth of cut of knife 100. Advantageously, such an embodiment can be used to decoratively score object 300, or to accordion object 300, wherein object 300, rather than being cut into individual slices, is cut into parallel incomplete slices, said cuts occurring only on one side of object 300, or on alternating sides. Object 300 may then be curled around its uncut side, similar to opening a book about its spine, or stretched apart, like an accordion. This embodiment can also be used to rapidly and easily de-vein shrimp. Those skilled in the art will appreciate that numerous alternate embodiments which limit depth of cut may be constructed. For example, the means of limiting depth may be separate from blade 110, or fabricated as part of blade 110. It may be fixed, or adjustable. It may consist of a movable or removable member which can act in turn as either a blade guard, a cutting-depth limiter, or be placed sequentially behind blade 110 so as to have no effect on either side of the thickness of blade 110, only acting in effect to extend the area of blade 110.

Finally, a variety of embodiments of support surface 200 can be designed by those skilled in the art, to permit flexible orientation of the substance to be cut relative to the cutting plane. This, e.g., can permit the precision creation of gourmet desserts such as a "layer" cake built up of pieces with triangular cross-sections.

It can therefore be appreciated from the foregoing that the disclosed knife alleviates many of the shortcomings typically associated with prior art knives. The primary advantage is that the disclosed knife together with the disclosed method produces even slices which are of a uniform pre-determined thickness. In addition, the knife of the present invention is of simple construction, relative not only to complex electric slicers but also even relative to knives with guides and mandolines. It is therefore also of relatively low manufacturing cost. Another advantage is that it can produce extremely thin slices without deformation of the cut substance because the substance to be cut only need support itself across its width, not its height. It is simple to use, requiring no complex ancillary stands and guides, power supply access, or guide adjustments. It can be used as a traditional knife as well as in the mode wherein uniform, even slices are assured. It can easily produce a varied depth of cut with a straight hinge line, e.g., for butterflying, unlike, e.g., rotary slicers. In alternate embodiments, it is easily adjustable to provide for a pre-determined variable thickness. It will not mar the support surface, either when used according to the disclosed horizontal slicing method, or even when used for vertical slicing, because various embodiments having a slight protrusion, no protrusion, or any recession of blade 110 across the forward line of tip 130 and handle 120 prevent blade 110 from contacting support surface 200. It provides leverage for cutting tough substances, such as frozen foods, because tip 130 and handle 140 together provide a means for see-sawing the blade. In an alternate embodiment, tip 130 is substantially identical in shape to handle 120, providing an easily grasped means for each hand to exert leverage so as to manipulate the knife through the foodstuff. In the typical embodiment, knife 100 and support surface 200 are easy to clean, because there are no parts to be disassembled, and no interstices which collect food particles/crumbs. Lastly, sharpening with a sharpening rod is aided because the knife is hindered from slipping off of the working surface of the sharpening rod by being moved past the tip.

It is understood that the embodiment of the invention presented above is exemplary, and that the invention is not limited to the specific forms described. Those skilled in the art will appreciate that such a cutting implement can be varied in a number of ways. Alternate embodiments of the invention provide the following, in addition to the benefits conferred by the illustrative embodiment.

The scope of application of knife 100 is not limited to slicing foodstuffs, but includes metals, wood, plastic, non-food biological matter, composite materials, etc.

Handle 120 and/or tip 130 may be fixed to blade 110 and/or detachable. FIGS. 12 through 20 illustrate a variety of attachment means. Those skilled in the art will appreciate that many others exist. If both handle 120 and tip 130 are detachable, a plurality of thicknesses of matched pairs of handle 120 and tip 130 may be attached to blade 110 as a means of pre-determining the slice thickness of knife 100. In fact, attachment of a variety of thicknesses of handle 120 or tip 130 is one means of adjusting cutting depth. Other means exist, which may be used singly, or together with an alternate means as long as cutting edge 112 is maintained parallel to support surface 200.

Tip 130, blade 110, and/or handle 120 may be fabricated with rule marks, to facilitate the measurement of the object before slicing. Such measurement could be useful, e.g., in selecting a pre-determined cutting thickness which would exactly halve the object, or slice it into exact thirds, or achieve some other pre-determined outcome.

A means may additionally be provided for lifting the remainder of the foodstuff off of the cut slice. For example, in working with a relatively fragile substance such as cake to create a layer cake, a large spatula-like object can be provided. In an alternate embodiment, said food lifting means can communicate with or be formed as part of blade 110.

A means may additionally be provided for protecting the hand holding the foodstuff. Such means may be a typical grasping utensil, such as a fork, or means specifically designed for use with the disclosed invention, such as a protective shield with tack-like protrusions which can help grasp the food while protecting the hand from heat, abrasion, or potential mishandling of the knife. Embodiments can easily be envisioned wherein such hand protection means is in some way integrated with support surface 200.

The material of the entirety of or components of blade 110 could be stainless steel, carbon steel, alloys, ceramic, plastic, composites, diamonds or other abrasives set into metal, combinations of these, etc.

Blade 110, handle 120, tip 130, and support surface 200 may be fabricated or assembled as a single contiguous object, or may be distributed clearly separate elements which cooperate to meet their required function as disclosed herein.

Handle 120 and tip 130 maybe made of molded plastic, wood, metal, ceramic, rubber, glass, combinations of these, e.g., metal coated with plastic, molded rubbery plastic inserted into a low-friction plastic sleeve, etc.

Handle 120, tip 130, and/or blade 110 may be all made of the same or different materials, material composites, or assemblies.

Handle 120, tip 130, and/or blade 110 may be assembled from different parts, machined from one contiguous raw substance, molded as one contiguous object, etc.

Handle 120 and tip 130 may have planar surfaces which slide against support surface 200 with a low coefficient of friction, or they may have roller bearings, casters, or similar mechanisms which ensure that knife 100 can smoothly engage in reciprocal and/or translational motion.

Blade 110, handle 120, and tip 130 may be individual components, or the entirety of knife 100 may be fabricated by molding, machining, casting or otherwise creating an article of manufacture which is a unified entity. The means of coupling blade 110 and handle 120 via handle tang 113 and between blade 110 and tip 130 via tip tang 114 may be via molding about the tang, a snap together assembly, joining via screws, fasteners, welding, etc.

Handle tang 113 and tip tang 114 may be non-interrupted contiguous areas, or may have means for mounting, assembly, or adjustment, e.g., as shown in FIGS. 12 through 16 and 18 through 20.

Blade 110 may be fabricated as one piece, or may be fabricated such that blade backbone 111 is separate from cutting edge 112. An example of such an alternative embodiment would be where cutting edge 112 is a piece of wire and blade backbone 111 is a relatively stiff piece of metal, distinctly separate from cutting edge 112. Another alternative embodiment would be where cutting edge 112 is a piece of wire and blade backbone 111 is fabricated together with handle 120 and tip 130 in a single contiguous arc.

Cutting edge 112 may be serrated, sawtooth with variety of number and shape of teeth, straight-edge, stiff wire, deformable wire made stiff via tensile force (used in conjunction with blade backbone 111), etc.

Cutting edge 112 may be sharpened to a fine edge, be unsharpened but have a fine irregularity or abrasives to facilitate cutting, be coated, etc.

Cutting edge 112 may be centered equidistant from the surfaces of handle 120 and tip 130 which may contact support surface 200, or asymmetrically mounted so as to be closer to one or the other parallel surface of handle 120 and tip 130. Such mounting allows knife 100 to be rotated 180 degrees about its longitudinal axis (i.e., flipped over) to pre-determine an alternate slice thickness.

Cutting edge 112 may be flush with handle 120 and tip 130, slightly recessed in the direction of cutting from handle 120 and tip 130, substantially recessed, or protrude beyond handle 120 and tip 130 in the direction of cutting. If cutting edge 112 is infinitesmally or substantially recessed, cutting edge 112 can never contact support surface 200, even when knife 100 is used perpendicularly to support surface 200, thus preventing marring or other damage to support surface 200. Even if flush with, or even slightly protruding beyond handle 120 and tip 130, cutting edge 112 will not contact support surface 200 when grasped and used at a normal cutting angle. Advantageously, the knife can then be grasped in such a way as to provide for an angle of 0 degrees to support surface 200 should it be momentarily desired to have cutting edge 112 contact support surface 200, e.g., so as to completely cut through object 300. In the case where cutting edge 112 is in fact substantively recessed from handle 120 and tip 130, such recession can be used to provide for a cut which does not completely separate the object being cut, thus supporting the creation of perfect accordion-like garnishes. If cutting edge 112 protrudes, when used for vertical cutting blade 110 can be used to cut entirely through the foodstuff, without interference from handle 120 or tip 130.

If blade backbone 111 is separate from cutting edge 112, blade backbone 111 may be of substantially the same or lesser thickness as cutting edge 112 and pass through the substance being sliced, or of greater thickness and remain outside the substance being sliced (as a hacksaw), or act as a cutting-depth limiter (as shown in FIGS. 24 and 25).

Blade 100 may have a single cutting edge 112 or a double cutting edge 112 (i.e., be double-edged).

Blade 100 may have one blade, or a plurality of aligned or offset parallel blades which are equidistant and create multiple slices concurrently of substantially identical thickness.

Cutting edge 112 may be straight, concave, or convex, wavy, or any other section, when viewed from the top.

Cutting edge 112 which is substantially perpendicular to the direction of cutting motion, or may be angled relative to the direction of cutting motion.

Blade 100 may be linear, rectilinear, triangular, crescent-shaped, etc., when viewed from above.

Handle 120 may be of the varieties used in "traditional" knives used for vertical cutting, or with indentations receiving one or more fingers, thus supporting slicing towards the body, slicing away from the body, or slicing vertically. Handle 120 may be well suited for slicing horizontally as well as vertically, or only for slicing horizontally, e.g., shaped as a computer "mouse" pointing device.

Handle 120 and tip 130 may be symmetric across the plane of the blade, or axially symmetric, e.g., two hemi-ovoids, one whose flat surface is in an opposing direction to the other, which cooperate to maintain cutting edge 112 always parallel to support surface 200 at a pre-determined distance. In fact, any three dimensional design for handle 120 and tip 130 which has at least three points, not all in a line, maximally distant from cutting edge 112 and parallel to said cutting edge, with handle 120 and tip 130 each containing at least one point and so describing points of contact with support surface 200 such that reciprocal motion traces a plane parallel to support surface 200 will suffice. Should blade 110, handle 120, and tip 130, exhibit full radial symmetry about the longitudinal axis of cutting edge 112, the condition above may be relaxed so that only two points need contact support surface 200. An example of an alternate embodiment meeting these criteria would be one where blade 110 is fabricated as an elongated cylinder, coated with abrasives, and handle 120 and tip 130 are spheres, with the centerline of said cylinder and center of said spheres are co-linear.

Tip 130 may be integrally formed or assembled with blade 110, or removable, as shown in FIGS. 18–20.

Tip 130 may be a tip as described in the illustrative embodiment, or may be a graspable handle as well, so that knife 100 is symmetric. This would be of value to help gain leverage in cutting particularly tough foodstuffs, such as frozen meats or poultry. A variation of this embodiment would be where tip 130 and handle 120 are not symmetric, although tip 130 is more than just a tip, as shown in FIGS. 21 to 23.

Figure 8:
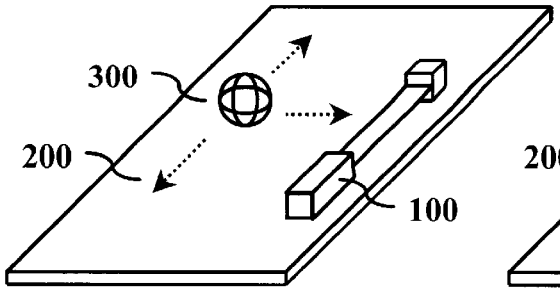
Figure 9:
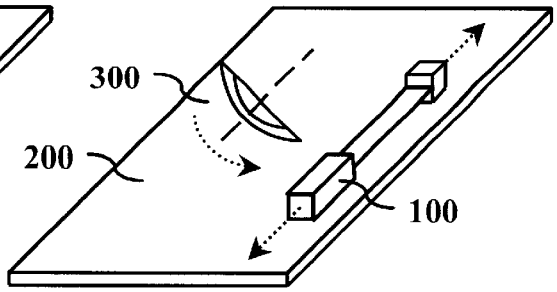

Knife 100 and support surface 200 may be manufactured so that knife 100 may be firmly attached and detached from support surface 200. When firmly attached, the object to be sliced would be moved towards the assembly of knife 100 and support surface 200, either in a constant linear motion and/or with simultaneous reciprocal translation (as shown in FIG. 8), rotation about an axis parallel (similar to FIG. 9) or skew (similar to FIG. 10) to cutting edge 112 such that the slicing is performed within a given radius of curvature from the axis of rotation, or a combination of these motions. Such use is similar to that of a traditional mandoline, but improves over the prior art in that foodstuffs are not deformed by their own weight and the curvature induced by a traditional mandoline as they are forced to travel through the cutting plane. The method described here is particularly appropriate for rapidly cutting through substances where little or no reciprocal motion is required. Such alternative embodiment has the added advantage that support surface 200—and thus, in turn, knife 100—may be braced against or otherwise fixed to a surface such as a countertop by a variety of means. In fact, support surface 200 may be a countertop, with means such as suction cups, vises or "fingers" used to attach knife 100 without permanently altering support surface 200. Clearly, a variety of embodiments of such a design are easy for those skilled in the art to design and build. For example, one such variation would have cutting edge 112 angled rather than parallel to a major axis of support surface 200. In another variation, blade backbone 111 is extended so as to form a platform wherein the top part of object 300 is fully supported during and after the completion of the slicing motion.

Support surface 200 may be implemented as a rectilinear object, such as a cutting board, may be a component of a pre-existing object, such as a countertop or tabletop, or may have various alternate embodiments and features such as handles, channels to catch liquids emanating from cut foodstuffs, means for affixing knife 100 to support surface 200, means for affixing support surface 200 to a countertop, such as rubber feet or vise grips, interior or exterior means for storing components such as a plurality of thicknesses of handle 120 and tip 130 intended for a variety of pre-determined slice thicknesses, etc.

The cross-section of the cutting edge 112 may be linear, as in the illustrative embodiment, or a non-linear shape such as a curve, or a square wave. If it is a shape, the knife will not be suited for reciprocal motion, but will be useful for cutting a particular type of cross-section, e.g., the periodic square or sine wave cut used to make waffle fries, when moved only in the direction of cut.

One object 300 may be sliced at a time, or a multiplicity of objects may be simultaneously or sequentially sliced.

Alternate embodiments may combine different grip/blade combinations with different methods. E.g., assume that object 300 is held in the left hand, and knife 100 is held in the right. Then, with cutting edge 112 facing to the left, knife 100 may be translated generally from right to left, and/or object 300 may be translated generally from left to right. Or, the arms may be crossed, with the cutting edge 112 facing right, so that knife 100 translates left to right, and/or object 300 translated generally from right to left. Or, object 300 maybe held further away from the body than knife 100, with cutting edge 112 facing away from the body, with knife 100 being translated generally in a direction away from the body while cutting, and/or object 300 being translated generally in a direction towards the body. Finally, object 300 may be held closer to the body than knife 100, with cutting edge 112 facing towards the body, with knife 100 being translated generally in a direction towards the body, and/or object 300 being translated generally in a direction away from the body. Different angles, grip styles, and similarity or inversion of grip direction and blade direction will generally correspond with the alternate methods just described.

For certain embodiments, and food substances, the cutting motion may vary, as shown in FIGS. 4 through 11, and/or the food separation technique may vary. E.g., if cutting edge 112 is a stiff wire or wire under tension, and object 300 is a cake, knife 100 may simply be moved in the direction of cut.

Such modifications and other configurations and constructions are, nevertheless, considered to be within the scope of this invention. Thus, these and other substitutions, modifications, changes and omissions may be made in the design and arrangement of the elements and in the manufacturing and assembly steps disclosed herein without departing from the scope of the appended claims.

I claim:

1. In combination with a planar support surface, apparatus comprising:

a cutting apparatus having a cutting edge which has a first end and a second end and adapted to cut material, and said cutting apparatus being movable with respect to said planar support surface;

a first support means for maintaining said first end a pre-determined distance from said planar support surface;

a second support means for maintaining said second end said pre-determined distance from said planar support surface;

whereby said first support means and said second support means cooperate to maintain said cutting edge substantially parallel to and said pre-determined distance from said planar support surface.

2. The apparatus of claim 1 where said handle is separate from said first support means.

3. The apparatus of claim 1 further comprising a handle, where said handle forms an integral part of said first support means.

4. The apparatus of claim 1 where said first support means and said second support means are removeable.

5. The apparatus of claim 1 including:

means for selecting said pre-determined distance from among two or more distances;

means for setting said first end said pre-determined distance from said planar support surface;

means for setting said second end said pre-determined distance from said planar support surface;

whereby said cutting edge is guided to move in a plane parallel to, and said pre-determined distance from, said support surface.

6. A method of using the apparatus of claim 1 for slicing an object comprising the steps of:

a. placing said cutting apparatus on said planar support surface;

b. placing said object on said planar support surface;

c. reciprocating said cutting apparatus while translating said cutting apparatus toward said object while maintaining contact between said object and said planar support surface and while maintaining contact between said cutting apparatus and said planar support surface;

whereby said object is partitioned into a bottom portion and a top portion where said bottom portion is level, even and of pre-determined thickness.

7. Apparatus of claim 1 where said cutting apparatus can be fixed to said planar support surface through the use of a temporary attachment means.

8. In combination with a planar support surface, apparatus comprising:

a cutting apparatus having a cutting edge, said cutting edge having a first end and a second end and adapted for cutting material in a cutting plane;

wherein the support surface has an uppermost locus of points defining a support plane substantially parallel to said cutting plane, said support surface placed below said cutting apparatus and therefore below said cutting plane;

a handle attached at said first end, where at least one handle-surface point on a handle-surface of said handle is in said support plane that is substantially parallel to, and below, said cutting plane, at a distance from said cutting plane, and all points of said handle that are not in said support plane are above said support plane;

a guide attached to said second end, where at least one guide-surface point on a guide-surface of the guide is in said support plane, at said distance from the cutting plane, and all other points of the guide that are not in said support plane are above the support plane.

9. The apparatus of claim 8 where the attached guide is removable.

10. The apparatus of claim 8 where both the attached handle and the attached guide are removable.

11. The apparatus of claim 8 where the handle and the guide are substantially of identical construction.

12. The apparatus of claim 8 where the cutting edge is substantially a straight line.

13. The apparatus of claim 8 where the cutting edge is serrated.

14. The apparatus of claim 8 where the handle-surface of said handle includes a plane that includes said at least one handle-surface point.

15. The apparatus of claim 8 where the guide-surface of said guide includes a plane that includes said at least one guide-surface point.

16. The apparatus of claim 8 where said cutting edge substantially forms a line and said handle and said guide are elongated along an axis that is parallel to said cutting edge.

17. The apparatus of claim 16 where said axis is substantially recessed from said cutting edge.

18. The apparatus of claim 16 where said cutting edge is substantially recessed from said axis.

19. The apparatus of claim 8 where said cutting edge substantially forms a line, and said handle is elongated along an axis that crosses said cutting edge.

20. The apparatus of claim 19 where a plane that is defined by said cutting edge and said axis is substantially parallel to said support plane.

21. The apparatus of claim 8 where said cutting edge is concave, forming a plane that is coincident with said cutting plane.

22. The apparatus of claim 8 where said cutting edge is convex, forming a plane that is coincident with said cutting plane.

23. The apparatus of claim 8 where said handle has at least one point on its surface that is in the cutting plane and extending ahead of said cutting edge, and said guide has at least one point on its surface that is in the cutting plane and extending ahead of said cutting edge.

24. The apparatus of claim 8 where neither said handle nor said guide have any points on their respective surfaces that are in the cutting plane and ahead of said edge.

25. The cutting apparatus of claim 8 further comprising a rigid support member that interconnects said handle and said guide.

26. The cutting apparatus of claim 8 further comprising means for affixing a guard along said cutting edge;

whereby said cutting apparatus can be safely stored or transported.

27. The apparatus of claim 26 where said means for affixing a guard are a recess in said handle and a recess in said guide.

28. The apparatus of claim 9 where said removable guide is attachable to said second end with a pin.

29. The apparatus of claim 8 further comprising means to add one or more spacers to said handle that effectively modify the surface of said handle; and means to add one or more spacers to said guide that effectively modify the surface of said guide;

to increase said distance.

30. The apparatus of claim 8 where said cutting edge includes a tang at said first end and said handle is attached to said first end by insertion of said tang into one of a plurality of cavities included in said handle and fitted for said tang.

31. The apparatus of claim 30 where said cavities in said handle are parallel to each other and said cutting plane.

32. The apparatus of claim 8 where said cutting edge includes a tang at said second end and said guide is attached to said second end by insertion of said tang into one of a plurality of cavities included in said guide and fitted for said tang.

33. The apparatus of claim 8 further comprising a means of limiting the depth of cut.

34. The apparatus of claim 8 further comprising a means of limiting the depth of cut and a means of adjusting said means of limiting the depth of cut;

whereby said depth of cut may be adjusted.

35. The apparatus of claim 8 further comprising a plurality of matched recesses in said handle and said guide and an elongated member insertable into said matched recesses.

36. The apparatus of claim 35 where said elongated member is inserted into a pair of matched recesses ahead of said cutting edge;

and said elongated member guards said cutting edge whereby said cutting apparatus may be safely stored and transported.

37. The apparatus of claim 35 where said elongated member is inserted into a pair of matched recesses behind the foremost portion of said cutting edge;

and said elongated member acts to limit the depth of cut of said cutting edge.

38. The apparatus of claim 35 where said elongated member is behind the trailing portion of said cutting edge and coplanar with said cutting edge;

whereby said elongated member is stored without interfering with the function of said cutting edge.

39. The apparatus of claim 36 where said cavities in said guide are parallel to each other and said cutting plane.

40. The apparatus of claim 8 further comprising one or more additional cutting edges, each adapted to cut in a respective cutting plane, where the respective cutting planes are parallel to said cutting plane.

41. The apparatus of claim 40 where the cutting edge forms a line, and said additional cutting edges form respective lines, and said line and said respective lines are in a plane that is perpendicular to said cutting plane.

42. The apparatus of claim 40 where the cutting edge forms a line, and said additional cutting edges form respective lines, and said line and said respective lines are in a plane that is at an angle other than ninety degrees to said cutting plane.

43. The apparatus of claim 40 where the cutting edge forms a line, and said additional cutting edges form respective lines, and said line and said respective lines fail to define a plane.

* * * * *